US006259046B1

(12) United States Patent
Iwama et al.

(10) Patent No.: US 6,259,046 B1
(45) Date of Patent: Jul. 10, 2001

(54) SHEET WITH MOVABLE CONTACTS AND SHEET SWITCH

(75) Inventors: Naoya Iwama; Takeo Yamagata, both of Miyagi-ken (JP)

(73) Assignee: Alps Electric Co., LTD, Tokyo (JP)

( * ) Notice: Subject to any disclaimer, the term of this patent is extended or adjusted under 35 U.S.C. 154(b) by 0 days.

(21) Appl. No.: 09/604,353

(22) Filed: Jun. 27, 2000

(30) Foreign Application Priority Data

Jun. 29, 1999 (JP) ..... 11-183237

(51) Int. Cl.[7] ..... H01H 9/26
(52) U.S. Cl. ..... 200/5 A; 200/512
(58) Field of Search ..... 200/5 A, 512, 200/314, 341

(56) References Cited

U.S. PATENT DOCUMENTS 4,367,385 * 1/1983 Frame ..... 200/159 B
4,375,018 * 2/1983 Petersen ..... 200/5 A
4,684,767 * 8/1987 Phalen ..... 200/5 A
4,771,139 * 9/1988 DeSmet ..... 200/5 A
5,399,823 * 3/1995 McCusker ..... 200/521
5,845,766 12/1998 Sako et al. .
5,924,555 7/1999 Sadamori et al. .

FOREIGN PATENT DOCUMENTS 6-131944 * 5/1994 (JP) .

* cited by examiner

*Primary Examiner*—Michael L. Gellner
*Assistant Examiner*—Nhung Nguyen
(74) *Attorney, Agent, or Firm*—Brinks Hofer Gilson & Lione

(57) ABSTRACT

The sheet with movable contacts comprises a first sheet formed by an insulating film, the first sheet having a plurality of receptacle holes and with adhesives applied respectively to both sides of the first sheet; a plurality of domed, metallic, movable contacts respectively received in the receptacle holes and having central small holes; and a second sheet formed by an insulating film and affixed onto the first sheet so as to cover upper surfaces of the plural movable contacts, wherein the first sheet has connecting slots formed therein for connecting adjacent such receptacle holes with each other, and each of the receptacle holes is larger than each of the small holes formed in the movable contacts and smaller than an external form of each of the movable contacts.

4 Claims, 3 Drawing Sheets

SHEET WITH MOVABLE CONTACTS AND SHEET SWITCH

BACKGROUND OF THE INVENTION

1. Field of the Invention

The present invention relates to a sheet with movable contacts and a sheet switch using the same, which are for use in operating panels of various electronic devices for example.

2. Description of the Related Art

A conventional structure of a sheet with movable contacts and that of a sheet switch are shown in FIGS. 5 and 6. FIG. 5 is a sectional view of the sheet with movable contacts and FIG. 6 is a sectional view of a sheet switch using the sheet with movable contacts.

In those figures, the sheet with movable contacts is made up of movable contacts 25 formed in a dome shape using metal, a sheet 21 formed by an insulating film, the sheet 21 covering upper surfaces of the movable contacts 25 and having an adhesive 23 applied to a lower surface thereof, and a separator sheet 26 affixed to the lower surface of the sheet 21 to close lower surfaces of the movable contacts 25, the separator sheet 26 being formed by paper or an insulating film.

The domed upper surfaces of the movable contacts 25 are covered with and fixed to the adhesive 23 which is applied to the lower surface of the sheet 21. The separator sheet 26 affixed to the lower surface of the sheet 21 is for preventing corrosion of the movable contacts 25 caused by gases contained in air or for preventing the adhesion of foreign matters to the movable contacts, during storage or transport of the sheet. The separator sheet 26 can be peeled off.

A small hole 25*a* is formed in a central portion of each movable contact 25, and on the lower surface portions of the sheet 21 which surround the small holes 25*a* there are formed sheet exposed portions 21*a* with the adhesive 23 not applied thereto. Since the small hole 25*a* is formed in the central portion of each movable contact 25, the movable contact comes into contact with a central fixed contact to be described later at an end face of an outer periphery of the small hole formed centrally of the movable contact 25, so that the contact of the movable contact with the central fixed contact is further ensured.

Since the sheet exposed portions 21*a* free of the adhesive 23 are formed on the lower surface portions of the sheet 21 which surround the small holes 25*a* of the movable contacts 25, it is possible to prevent the entry of the adhesive 23 onto inner surfaces of the movable contacts from the small holes 25*a*.

As shown in the figures, the sheet 21 is provided with sheet exposed portions 21*b* with the adhesive 23 not applied thereto, in the vicinity of lower ends of outer peripheral portions of the movable contacts 25, whereby it is also possible to prevent the entry of the adhesive 23 from the lower ends of the outer peripheral portions of the movable contacts 25.

The sheet switch is made up of the above sheet with movable contacts and a circuit board 27 provided on an upper surface thereof with central fixed contacts 29 and outer fixed contacts 28. In a removed state of the separator sheet 26 from the sheet with movable contacts, the movable contacts 25 are affixed onto the circuit board 27 using the adhesive 23 applied to the lower surface of the sheet 21 in such a manner that lower ends of the outer peripheries of the movable contacts 25 are respectively brought into abutment with the outer fixed contacts 28 and that central portions thereof are opposed to the central fixed contacts 29.

In the above structure of the sheet switch, when an operating portion of a rubbery or resinous push-button (not shown) disposed above the sheet switch is depressed, the associated movable contact 25 is depressed by a depressing portion formed on a lower surface of the operating portion via the sheet 21 and is inverted, so that its central portion comes into abutment against the associated central fixed contact 29 on the circuit board, whereby the central fixed contact 29 and the associated outer fixed contact 28 on the circuit board 27 are electrically connected with each other. Upon release of the depressing force imposed on the push-button, the central portion of the movable contact 25 is disconnected from the central fixed contact 29 with an elastic restoring force of the movable contact.

In the above conventional structures of the sheet with movable contacts and the sheet switch, however, the movable contacts 25 are covered with and fixed to a single sheet 21 of an insulating film with the adhesive 23 applied to the lower surface of the sheet, so when the sheet with movable contacts is affixed onto the circuit board 27 and when any of the domed movable contacts 25 located near the outer periphery of the sheet 21 is depressed, the air present within the dome of the movable contact is forced out and causes an end portion of the sheet to float, thus giving rise to the problem that dust enters through the floating end portion and causes an incomplete state of contact.

Moreover, the portions of the sheet 21 which surround the domed movable contacts 25 are fixed with the adhesive 23, so when any of the movable contacts 25 is depressed, the air present within the dome of the depressed movable contact cannot escape anywhere, thus giving rise to the problem that the operation feeling is deteriorated.

Further, it is required that the adhesive 23 be applied to the lower surface of the sheet 21 by such a printing method as masking so as to prevent the adhesive from being applied to the small holes 25*a* formed respectively in the central portions of the movable contacts 25, thus causing the problem that the production becomes complicated and the manufacturing cost increases.

SUMMARY OF THE INVENTION

Accordingly, it is an object of the present invention to solve the above-mentioned problems and provide a structure of a sheet with movable contacts and a structure of a sheet switch using the sheet which, even when a movable contact located near an outer periphery of the sheet is depressed, can prevent floating of the sheet and can thereby prevent the entry of dust, thus affording a high contact reliability, and which can afford a good operation feeling at the time of operation and is easy to fabricate and low in cost.

For solving the above-mentioned problems, according to one aspect of the present invention, there is provided a sheet with movable contacts, comprising a first sheet formed by an insulating film, the first sheet having a plurality of receptacle holes and with adhesives applied respectively to both sides of the first sheet, a plurality of domed, metallic, movable contacts respectively received in the receptacle holes and having central small holes, and a second sheet formed by an insulating film and affixed onto the first sheet so as to cover upper surfaces of the plural movable contacts, wherein the first sheet has connecting slots formed therein for connecting adjacent such receptacle holes with each other, and each of the receptacle holes is larger than each of the small holes formed in the movable contacts and smaller than an external form of each of the movable contacts.

In another aspect of the present invention, outer peripheral end portions in the external form of the movable contacts except the small holes are affixed to the lower surface of the first sheet through the adhesive applied to the first sheet lower surface and are received in the receptacle holes respectively.

In a further aspect of the present invention, a separator sheet whose upper surface has been subjected to a release treatment is affixed to the lower surface of the first sheet so as to be releasable from the first sheet.

In a still further aspect of the present invention there is provided a sheet switch comprising a circuit board having a plurality of fixed contacts; a plurality of domed, metallic, movable contacts each having a small hole formed in a central portion thereof; a first sheet having a plurality of receptacle holes and connecting slots for connecting adjacent such receptacle holes with each other, the receptacle holes being each larger than the small hole formed in each of the movable contacts and smaller than an external form of each of the movable contacts; and a second sheet formed by an insulating film and affixed onto the first sheet, wherein the domed, metallic, movable contacts are received respectively in the receptacle holes of the first sheet so as to be opposed to the fixed contacts on the circuit board and in this state the first sheet is affixed onto the circuit board.

DETAILED DESCRIPTION OF A PREFERRED EMBODIMENT

Figure 1:
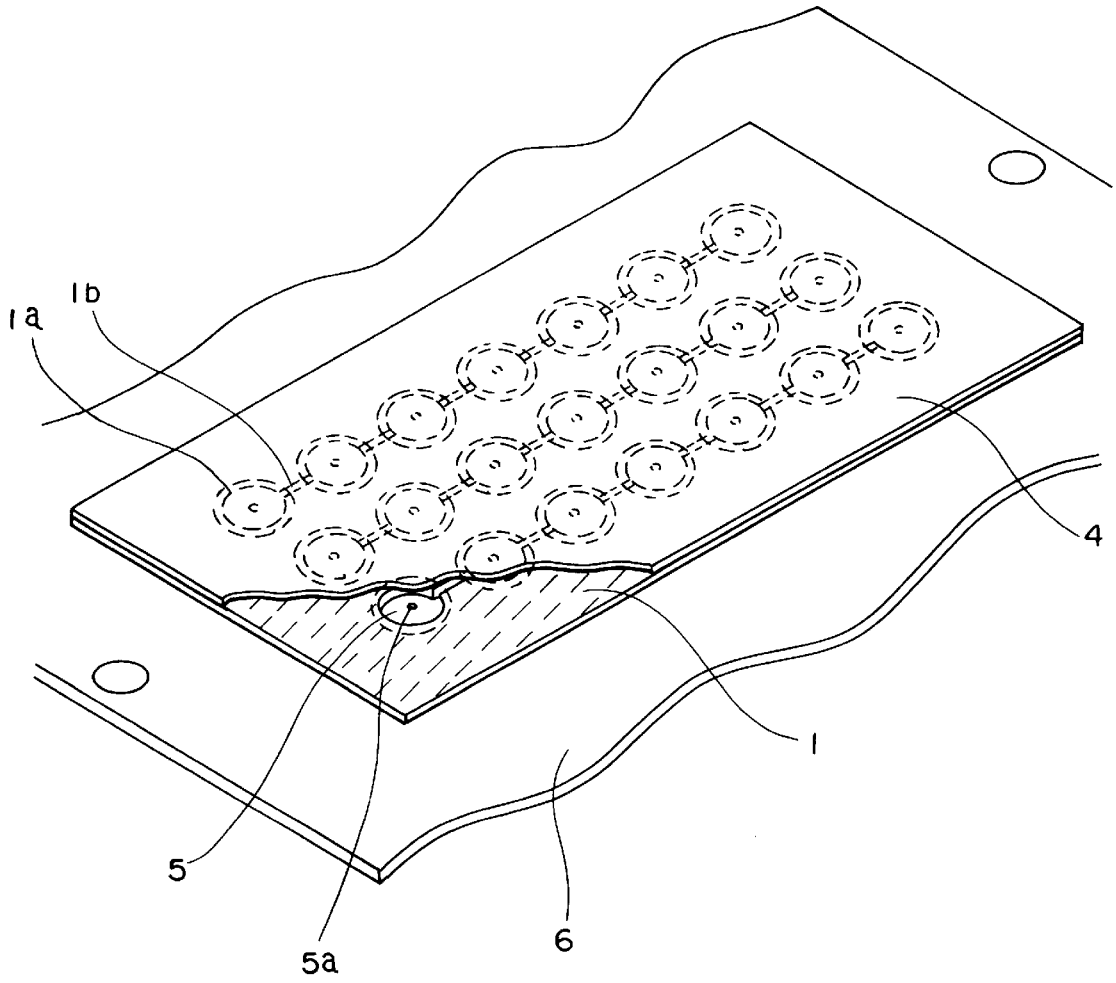
FIG. 1 is a partially cut-away perspective view showing a sheet with movable contacts according to the present invention.
Figure 2:
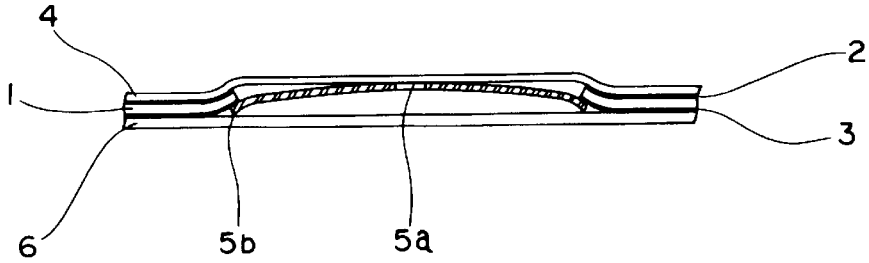
FIG. 2 is a sectional view showing a movable contact portion of the sheet.

An embodiment of the present invention will be described in detail hereinunder with reference to FIGS. 1 to 4. FIGS. 1 and 2 show a structure of a sheet with movable contacts embodying the present invention, of which FIG. 1 is a partially cut-away perspective view of the sheet and FIG. 2 is a sectional view of a movable contact portion.

In FIGS. 1 and 2, a first sheet 1 is formed by a film of an insulating material such as a synthetic resin, e.g. PET (polyethylene terephthalate), with adhesives 2 and 3 being applied throughout upper and lower surfaces, respectively, of the first sheet 1 to form adhesive surfaces. In the first sheet 1 are formed a plurality of circular receptacle holes 1*a* for receiving therein movable contacts to be described later, the receptacle holes 1*a* having connecting slots 1*b* for connecting adjacent such receptacle holes 1*a* with each other.

The receptacle holes 1*a* are each formed so as to be larger than a small hole formed in each of movable contacts to be described later and smaller than an external form of each movable contact.

A second sheet 4, like the first sheet 1, is also formed by a film of an insulating material such as a synthetic resin, e.g. PET (polyethylene terephthalate).

Movable contacts 5 are each formed in the shape of a dome having a central portion with use of a resilient metallic material such as stainless steel or phosphor bronze. The central portion is inverted to the opposite side when depressed with an external force.

A separator sheet 6 is formed by a film of an insulating material such as paper or a synthetic resin. An upper surface of the separator sheet 6 has been subjected to a release treatment so as to be releasable from the adhesive lower surface of the first sheet 1 to which the adhesive 3 is applied. The separator sheet 6 is affixed to the lower surface of the first sheet 1 so as to close the plural receptacle holes 1*a*.

The sheet with movable contacts constructed as above is assembled in the following manner. First, the receptacle holes 1*a* and connecting slots 1*b* are formed in plural positions as necessary of the first sheet 1. Next, the second sheet 4 is registered with and affixed to the adhesive upper surface of the first sheet 1 to which the adhesive 2 is applied.

Next, the movable contacts 5 are inserted through the plural receptacle holes 1*a* formed in the lower surface of the sheet 1 and the movable contacts are affixed, each at an outer peripheral end portion of the dome external form, to the adhesive lower surfaces of the first sheet 1 on the underside of the receptacle holes 1*a* to which lower surfaces the adhesive 3 is applied. In this state the central portions of the movable contacts 5 are abutted against a lower surface of the second sheet 4 and the movable contacts are received respectively in the receptacle holes 1*a* of the first sheet 1. Lastly, the the upper surface of the separator sheet 6 is registered with and affixed to the adhesive lower surface of the first sheet 1 to which the adhesive 3 is applied, to complete the assembly.

In the above structure of the sheet with movable contacts according to the present invention, when the movable contacts 5 are affixed to the first sheet 1, the adhesive surface of the first sheet 1 with the adhesive 3 applied thereto is not affixed to the central small holes 5*a* and the peripheral surfaces thereof in the movable contacts 5, so there is no fear of entry of the adhesive 3 to the inner surface side of the movable contacts through the small holes 5*a*, whereby it is possible to prevent the occurrence of an incomplete state of contact.

Moreover, since no adhesive is applied to the second sheet 4, it is not necessary to adopt such a printing method as masking for the application of an adhesive while avoiding application of the adhesive to the abutted portions of the second sheet against the central portions of the movable contact. Consequently, production becomes easier and it is possible to attain the reduction of cost.

Figure 3:
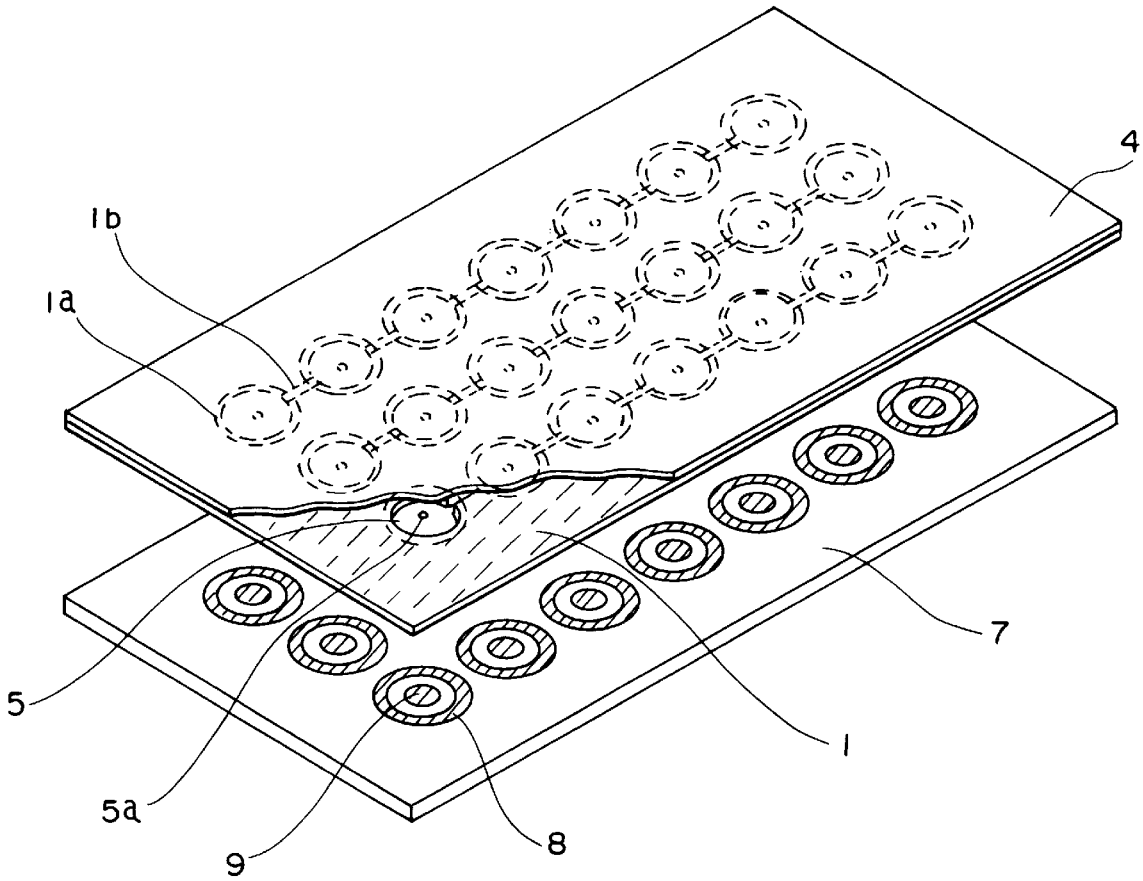
FIG. 3 is a partially cut-away exploded perspective view showing a sheet switch using the sheet with movable contacts.
Figure 4:
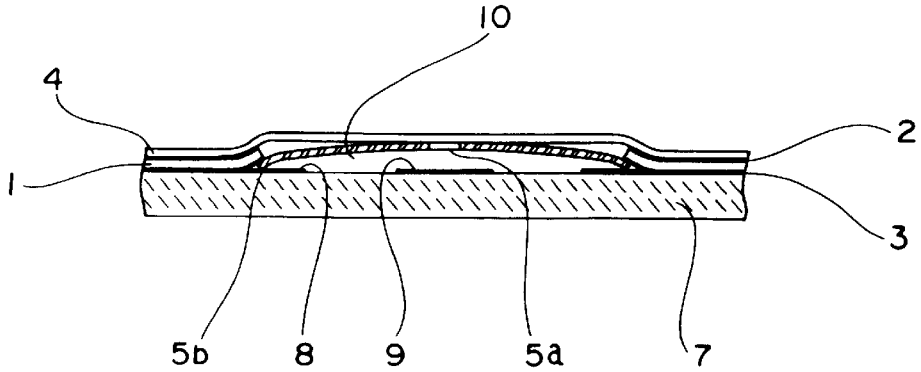
FIG. 4 is a sectional view showing a movable contact portion and a fixed contact portion of the sheet switch.
Figure 5:
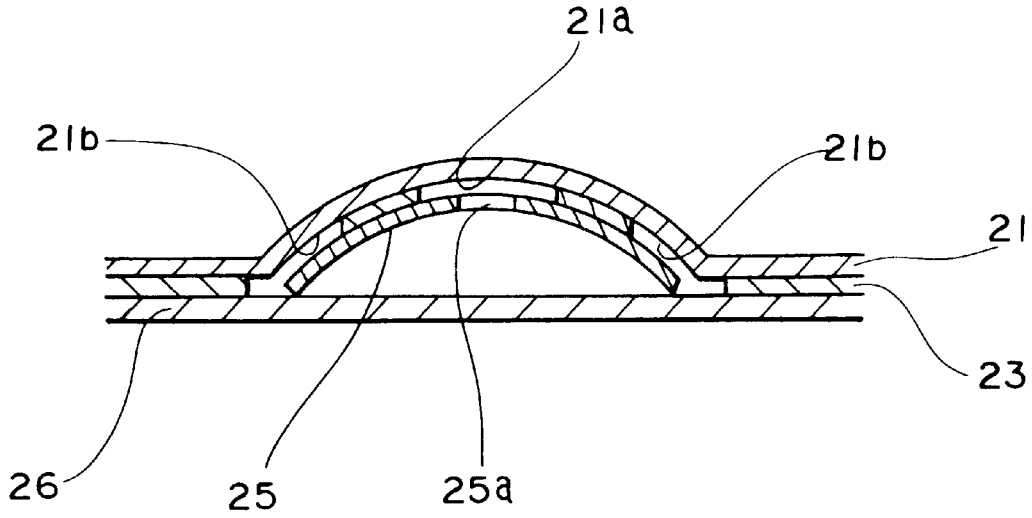
FIG. 5 PRIOR ART
FIG. 5 is a sectional view showing a movable contact portion in a conventional sheet with movable contacts.
Figure 6:
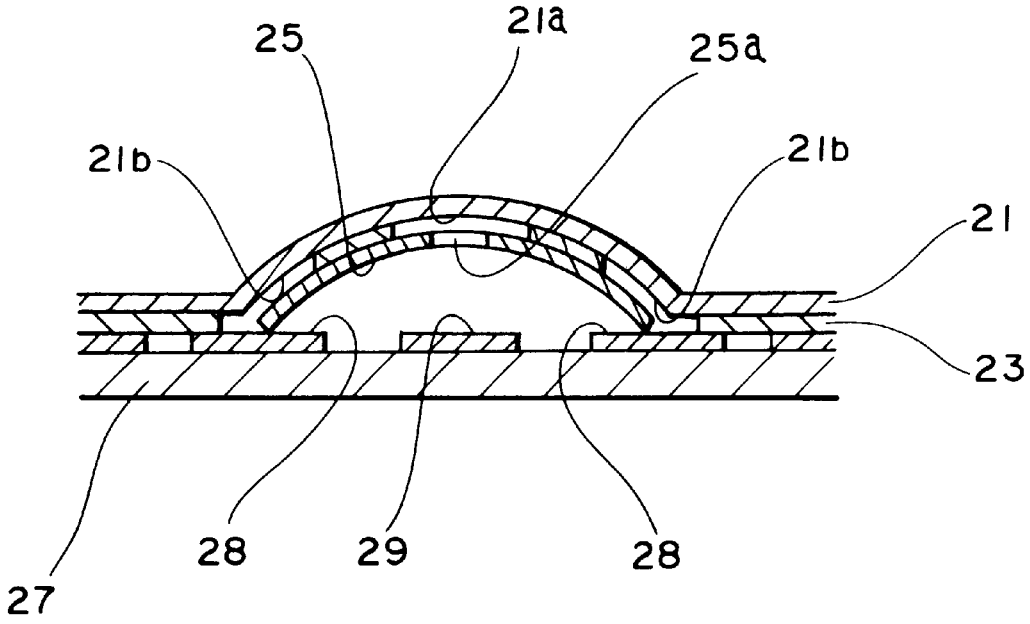
FIG. 6 PRIOR ART
FIG. 6 is a sectional view showing a movable contact portion and a fixed contact portion in a conventional sheet switch.

FIGS. 3 and 4 show a structure of a sheet switch using the sheet with movable contacts according to the present invention, of which FIG. 3 is a partially cut-away exploded perspective view of the sheet switch and FIG. 4 is a sectional view of a movable contact portion and a fixed contact portion. In both figures, the same components as in FIGS. 1 and 2 are identified by the same reference numerals as in FIGS. 1 and 2 and explanations thereof will here be omitted.

In FIGS. 3 and 4, a circuit board 7 is formed, for example, by an insulating laminate such as a phenolic resin laminate. On the circuit board 7 are formed a plurality of circuit patterns of outer fixed contacts 8 and central fixed contacts 9 by, for example, printing carbon or etching copper foil.

The sheet switch is assembled in the following manner. The separator sheet 6 is peeled off from the sheet with movable contacts, for example, by pulling it with hands. Thereafter, the sheet with movable contacts is positioned onto the circuit board and the movable contacts, whose upper surfaces are affixed to the first sheet 1 and which are received in the receptacle holes 1*a* of the first sheet, are affixed onto the circuit board 7 through the adhesive lower surface of the second sheet 4 with the adhesive 5 applied thereto in such a manner that lower ends 5*b* of outer peripheries of the movable contacts 5 are abutted against the outer fixed contacts 8 and that the central small holes 5*a* of the movable contacts are opposed to the central fixed contacts 9. The assembly is now over.

The operation of the sheet switch thus constructed will now be described. When an operating portion of any of rubbery or resinous push-buttons (not shown) disposed above the sheet switch is depressed, the associated movable contact 5 is depressed through the second sheet 4 and is inverted thereby, with the result that an outer peripheral end face of the small hole 5*a* formed in the movable contact comes into abutment against the associated central fixed contact 9 on the circuit board 7, whereby the central fixed contact is electrically connected with the associated outer fixed contact 8. Upon release of the depressing force imposed on the push-button, the central portion of the movable contact 5 is disconnected from the central fixed contact 9 with an elastic restoring force of the movable contact 5.

In the above structure of the sheet switch according to the present invention, a plurality of circular receptacle holes 1*a* for receiving the movable contacts 5 therein are formed in the first sheet 1 and connecting slots 1*b* for connecting adjacent receptacle holes 1*a* with each other are formed in the receptacle holes 1*a,* so when any of the movable contacts 5 is depressed through the second sheet 4, air 10 present in the dome of the movable contact 5 which is dome-shaped is conducted to the next receptacle hole 1*a* through the connecting slot 1*b* located therebetween. Therefore, also when any of the movable contacts 5 located near an outer peripheral portion of the first sheet 1 is depressed, the air 10 present in the dome of the movable contact is forced out, thus preventing an end portion of the first sheet 1 from being floated by the air, whereby it is possible to prevent the entry of dust from the sheet end portion which would cause an incomplete state of contact.

Besides, when any of the movable contacts 5 is depressed, an escape place for the air 10 present in the dome of the domed movable contact is ensured in adjacent receptacle holes 1*a* formed in the first sheet 1, so that the movable contact 5 can surely be inverted within the associated receptacle hole 1*a,* thus affording a good operation feeling.

As set forth above, in the structure of the sheet with movable contacts according to the present invention, since the first sheet having plural receptacle holes and with adhesives applied to both sides thereof is formed with connecting slots for connecting adjacent receptacle holes with each other, the receptacle holes being each larger than the small hole formed in each movable contact and smaller than the external form of each movable contact, the air present in the dome of each domed movable contact can pass through the associated connecting slot and escape to the next receptacle hole, thus ensuring an inverting motion of the movable contact within the receptacle hole and affording a good operation feeling. Besides, since it is not necessary to adopt such a printing method as masking for the application of adhesive, production becomes easy and it is possible to attain the reduction of cost.

Moreover, since the outer peripheral end portion in the external form of each movable contact except the small hole portion is affixed to the adhesive lower surface of the first sheet and in this state the movable contact is received in the associated receptacle hole, there is no fear of entry of the adhesive to the inner surface side of the movable contact through the small hole and hence it is possible to prevent the occurrence of an incomplete state of contact.

Moreover, since the separator sheet whose upper surface has been subjected to a release treatment is affixed to the lower surface of the first sheet so as to be releasable from the first sheet, it is possible to prevent corrosion caused by gases contained in the air and also prevent the adhesion of foreign matters to the first sheet and movable contacts, during storage or transport.

Further, in the first sheet having plural receptacle holes and with adhesives applied to both sides thereof there are formed connecting slots for connecting adjacent receptacle holes with each other, the receptacle holes being each larger than the small hole formed in each movable contact and smaller than the external form of each movable contact. The sheet with movable contacts thus constructed is affixed onto the circuit board with the adhesive applied to the lower surface of the first sheet. Accordingly, the air present in the dome of each domed movable contact can escape into the next receptacle hole through the associated connecting slot and hence the movable contact can surely be inverted within the associated receptacle hole, thus affording a good operation feeling. Additionally, also when any of the movable contacts located near the outer periphery of the sheet switch is depressed, it is possible to prevent floating of the sheet and hence possible to prevent the entry of dust, thereby ensuring a stable contact.

What is claimed is:

1. A sheet with movable contacts, comprising:

a first sheet formed by an insulating film, the first sheet having a plurality of receptacle holes and with adhesives applied respectively to both sides of the first sheet;

a plurality of domed, metallic, movable contacts respectively received in the receptacle holes and having central small holes; and a second sheet formed by an insulating film and affixed onto the first sheet to cover upper surfaces of the plural movable contacts, wherein the first sheet has connecting slots formed therein for connecting adjacent receptacle holes with each other, and each of the receptacle holes is larger than each of the small holes formed in the movable contacts and smaller than an external form of each of the movable contacts.

2. A sheet with movable contacts according to claim 1, wherein outer peripheral end portions in the external form of the movable contacts except the small holes are affixed to an adhesive-applied lower surface of the first sheet and in this state the movable contacts are received respectively within the receptacle holes.

3. A sheet with movable contacts according to claim 2, wherein a separator sheet whose upper surface has been subjected to a release treatment is affixed to the lower surface of the first sheet so as to be releasable from the first sheet.

4. A sheet switch comprising:

a circuit board having a plurality of fixed contacts;

a plurality of domed, metallic, movable contacts each having a small hole formed in a central portion thereof;

a first sheet having a plurality of receptacle holes and connecting slots to connect the adjacent receptacle holes with each other, the receptacle holes being each larger than the small hole formed in each of the movable contacts and smaller than an external form of each of the movable contacts; and a second sheet formed by an insulating film and affixed onto the first sheet, wherein the domed, metallic, movable contacts are received respectively in the receptacle holes of the first sheet to be opposed to the fixed contacts on the circuit board and, in this state, the first sheet is affixed onto the circuit board.

* * * * *